US010690306B2

(12) United States Patent
Hierzer

(10) Patent No.: US 10,690,306 B2
(45) Date of Patent: Jun. 23, 2020

(54) LUMINAIRE

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 6 days.

(21) Appl. No.: 15/909,257

(22) Filed: Mar. 1, 2018

(65) Prior Publication Data

US 2018/0252376 A1 Sep. 6, 2018

(30) Foreign Application Priority Data

Mar. 1, 2017 (DE) ..... 10 2017 203332

(51) Int. Cl.

| | |
|---|---|
| ***F21S 8/04*** | (2006.01) |
| ***F21V 21/02*** | (2006.01) |
| ***F21V 17/16*** | (2006.01) |
| ***F21V 19/00*** | (2006.01) |
| ***F21S 8/02*** | (2006.01) |

(Continued)

(52) U.S. Cl.

CPC . *F21S 8/04* (2013.01); *F21S 8/02* (2013.01); *F21V 17/164* (2013.01); *F21V 19/003* (2013.01); *F21V 21/025* (2013.01); *F21S 2/005* (2013.01); *F21V 3/02* (2013.01); *F21V 19/0045* (2013.01); *F21V 19/0095* (2013.01); *F21V 21/005* (2013.01); *F21V 21/35* (2013.01); *F21V 23/06* (2013.01); *F21Y 2105/10* (2016.08); *F21Y 2115/10* (2016.08)

(58) Field of Classification Search

CPC ..... F21S 8/04; F21S 8/02; F21S 2/005; F21V 17/164; F21V 19/003; F21V 21/025; F21V 3/02; F21V 19/0045; F21V 19/0095; F21V 21/005; F21V 21/35; F21V 23/06; F21Y 2105/10; F21Y 2115/10

USPC ..... 362/147

See application file for complete search history.

(56) References Cited

U.S. PATENT DOCUMENTS

| | | | |
|---|---|---|---|
| 6,871,983 | B2 | 3/2005 | Frederick et al. |
| 8,926,134 | B2 | 1/2015 | Hast et al. |

(Continued)

FOREIGN PATENT DOCUMENTS

| | | | |
|---|---|---|---|
| CA | 2828506 | A1 | 3/2015 |
| DE | 10297364 | T5 | 10/2004 |

(Continued)

OTHER PUBLICATIONS

Office Action for related German Patent Application No. 10 2017 203 332 dated Oct. 9, 2017.

(Continued)

*Primary Examiner* — Anh T Mai
*Assistant Examiner* — Jessica M Apenteng
(74) *Attorney, Agent, or Firm* — Millen, White, Zelano & Branigan, P.C.; William Nixon

(57) ABSTRACT

A luminaire includes a housing with a first side wall, a second side wall opposite the first side wall and a cover wall connecting the two side walls. The luminaire further includes a lamp device with a support plate and at least one luminous element, and a holder that couples the support plate of the lamp device to the side walls such that the support plate, together with the side walls and the cover wall, define an enclosed receiving space. An electrical connection device that is electrically connected to the lamp device is arranged in the enclosed receiving space.

13 Claims, 3 Drawing Sheets

(51) Int. Cl.

| | |
|---|---|
| *F21V 3/02* | (2006.01) |
| *F21V 23/06* | (2006.01) |
| *F21Y 115/10* | (2016.01) |
| *F21V 21/35* | (2006.01) |
| *F21Y 105/10* | (2016.01) |
| *F21S 2/00* | (2016.01) |
| *F21V 21/005* | (2006.01) |

(56) References Cited

U.S. PATENT DOCUMENTS

| | | | | |
|---|---|---|---|---|
| 9,551,821 | B2 | 1/2017 | Suzuki et al. | |
| 9,951,913 | B2 | 4/2018 | Skergeth et al. | |
| 10,017,108 | B2 | 7/2018 | Suzuki et al. | |
| 2003/0081419 | A1 | 5/2003 | Frederick et al. | |
| 2013/0058091 | A1 | 3/2013 | Hast et al. | |
| 2014/0198491 | A1* | 7/2014 | Schlueter | F21V 3/0625 362/147 |
| 2015/0146433 | A1 | 5/2015 | Suzuki et al. | |
| 2016/0195250 | A1* | 7/2016 | Park | F21S 8/038 362/219 |
| 2016/0305616 | A1* | 10/2016 | Lin | F21S 8/00 |
| 2017/0096096 | A1 | 4/2017 | Suzuki et al. | |

FOREIGN PATENT DOCUMENTS

| | | | |
|---|---|---|---|
| DE | 202012102874 | U1 | 4/2013 |
| DE | 102012107303 | B3 | 11/2013 |
| DE | 202014100951.1 | U1 | 7/2015 |
| EP | 2848469 | A1 | 3/2015 |
| EP | 2884158 | A1 | 6/2015 |
| EP | 2952806 | A1 | 12/2015 |
| JP | 2005019299 | A2 | 1/2005 |

OTHER PUBLICATIONS

English Abstract for EP2884158, Publication Date: Jun. 17, 2015.
English Abstract for DE202012102874, Publication Date: Apr. 23, 2013.
European Search Report for EP18159220 dated Jul. 16, 2018.
English Abstract of DE-102012107303, Publication Date: Nov. 7, 2013.
Decision to Grant in the corresponding European application EP18159220.5 dated May 27, 2019 (pp. 1-6).

* cited by examiner

LUMINAIRE

TECHNICAL FIELD

The present invention relates to a luminaire, in particular for attachment to a ceiling of a room of a building and in particular for illuminating the room.

BACKGROUND

Ceiling-mounted luminaires often comprise elongate, rail-like housings, in which a lamp device for emitting light and an electrical connection device, such as connection terminals and electronic ballasts, are arranged. For safety reasons, in order to prevent unwanted or unintended access to the connection device, which in certain circumstances is under electrical voltage, separation profiles are usually inserted into the housing. The separation profiles are inserted into the housing such that they define, together with the housing, an enclosed space, in which the connection device is arranged. At the same time, the separation profile acts as a support for the lamp device, which is fastened on a side of the separation profile facing away from the connection device.

Separation profiles are mostly plastics components, on which the lamp device and optionally also the connection device are installed and which have to be fastened to the housing of the luminaire. This design is structurally complex and requires a large number of steps during installation.

SUMMARY OF THE INVENTION

One idea of the present invention is to provide a luminaire that has a structurally simple design and provides a high degree of security against unwanted access to electrical connection devices.

According to the invention, a luminaire is provided with a housing that extends in a longitudinal direction and that comprises a first side wall, a second side wall opposite the first side wall and a cover wall connecting the two side walls. The luminaire further comprises a lamp device having a support plate and at least one luminous element, which is arranged on a first surface of the support plate. Furthermore, the luminaire comprises a holder, which couples the support plate of the lamp device to the side walls such that the support plate, together with the side walls and the cover wall, define an enclosed receiving space. An electrical connection device of the luminaire that is electrically connected to the lamp device is arranged in the enclosed receiving space.

According to the invention, a luminaire is thus provided which comprises an elongate housing that extends in a longitudinal direction. The housing is formed of a cover wall or a cover portion, which may for example be planar, and two side walls or side portions, which are arranged opposite one another in relation to a transverse direction, which extends transversely to the longitudinal direction. The side portions are mechanically connected by means of the cover wall and extend at least in a region opposite the cover wall transversely to the cover wall and thus in a vertical direction that extends transversely to the longitudinal or transverse direction. In particular, in relation to the transverse direction, the side walls define a light outlet opening. The housing can thus be U-shaped, for example. The cover wall and the side walls may be produced in particular in one piece, for example from a metal material such as aluminum or an aluminum alloy.

The luminaire according to the invention further comprises a lamp device comprising a planar support or support plate. One or more lighting units, i.e. light-emitting elements, are arranged on the first surface of the support plate. The support may in particular be designed as a circuit board or a printed circuit board.

The support plate is mechanically coupled to the housing, in particular to the side walls, by means of a holder. The support plate extends between the side walls, the first surface of the support plate on which the lighting units are arranged facing the light outlet opening and a second surface of the support plate that is oriented in an opposite manner to the first surface of the support plate facing the cover wall. The holder in particular couples a first edge region of the support plate to the first side wall and a second edge region of the support plate to the second side wall, which second edge region is opposite the first edge region of the support plate with respect to the transverse direction. In this way, the holder couples the support plate to the side walls such that the support plate, together with the side walls and the cover wall, define an enclosed receiving space, in which the electrical connection device is arranged. When viewed in the longitudinal direction, the connection device is thus completely surrounded by the housing and the lamp support. The lamp support and thus the lamp device itself in this case therefore form the receiving space. As a result, unwanted access to the connection device via the lamp device is prevented, and additional separation profiles can be dispensed with. In this way, extremely reliable protection against unwanted access to the connection device is achieved using a minimal number of components, which also simplifies installation of the luminaire.

According to some embodiments of the luminaire, a transparent cover may be additionally provided, a main portion of which extends between the side walls and which is fastened to the side walls. The main portion may thus be designed as a plate or a generally planarly extending part that extends in the transverse direction and is transparent to light in the visible wavelength range. A direct view of the lighting units may thus be prevented by means of the cover, which is advantageous for aesthetic reasons. Furthermore, the cover forms additional protection against access to the connection device. Furthermore, the optical properties of the light that can be emitted by the lighting units, for example the light colour, the light temperature, the distribution of light or similar parameters, can be beneficially influenced by the choice of material for the main portion of the cover. The main portion of the cover may in particular be formed from a plastics material, in particular a transparent thermoplastic material, such as polymethylmethacrylate or acrylic glass.

According to some embodiments, the cover may comprise a first side portion and a second side portion, the side portions each extending transversely to the main portion, and the first side portion extending along the first side wall and the second side portion extending along the second side wall. Accordingly, the cover is designed to be approximately U-shaped. This in particular produces the advantage that the cover can be easily inserted into the light outlet opening delimited by the side walls of the housing. The side portions of the cover may optionally be secured to the side walls of the housing due to them extending along said side walls. The side portions of the cover may in this case also be transparent to light in the visible wavelength range. In particular, the main portion and the side portions may be formed in one piece. This brings the possibility of producing the cover in a cost-effective manner in a plastics injection-moulding process or in a similar way.

According to some embodiments, the holder is formed on the side portions of the cover. Accordingly, a holding structure is in each case formed on one or both side portions of the cover, which holding structure is suitable for securing the support plate of the lamp device to the relevant side portion. In this case, the support plate is thus coupled to the housing via the cover. In this way, the lamp device can be pre-installed on the cover and the cover can then be fastened to the housing. This quickens and simplifies installation of the luminaire.

Alternatively, a holding structure of this kind forming the holder may also be formed in one piece with the side walls of the housing or from one or more parts that are separate from the relevant side wall and that are fastened thereto.

The holder or holding structure forming same may in particular be formed by a first latching portion formed in the first side portion of the cover and by a second latching portion formed in the second side portion of the cover, an edge region of the support plate of the lamp device being received in the latching portions. Accordingly, the support plate of the lamp device is interlockingly held in or latched to latching portions or latching devices provided on the side portions.

The latching portions may in particular each be formed by a receiving groove provided in the relevant side portion, which groove in each case extends in the longitudinal direction and which in each case receives an edge portion of the support plate of the lamp device. Grooves or channels held. For example, the support plate can be clamped in the cross-section of the groove. It is also conceivable for the side portions and/or the main portion of the cover to be made of a resilient material, for example a plastics material, and for the first and second receiving groove to be prestressed towards one another, i.e. in the transverse direction, on account of the resilience thereof. Due to the support plate of the lamp device being secured to the side portions in an interlocking manner, the support plate is thus secured to the housing in a reliable and secure manner by means of a structurally simple solution using a minimal number of components. This also simplifies installation of the luminaire.

According to some embodiments, the side portions of the cover are latched to the side walls of the housing in an interlocking manner. Accordingly, the cover is secured to the housing such that the side portions or latching structures provided thereon are engaged in latching structures provided on the relevant side wall of the housing. The cover is therefore secured to the housing in an interlocking manner. For the installation, the cover can for example be pushed into the light outlet opening in the vertical direction until the side portions of the cover are latched onto the side walls.

The side portions of the cover may be interlockingly secured to the side walls of the housing for example by a first cover-latching structure, for example in the form of a latching lug, being formed on an outer surface of the first side portion of the cover that faces the first side wall of the housing, which cover-latching structure engages in a first housing-latching structure, for example in the form of a latching recess, formed on the first side wall, and by a second cover-latching structure, for example in the form of a latching lug, being formed on an outer surface of the second side portion of the cover that faces the second side wall of the housing, which cover-latching structure engages in a second housing-latching structure, for example in the form of a latching recess, formed on the second side wall.

According to some embodiments of the luminaire, a first undercut region, which is delimited by mutually spaced hook-shaped lugs, is formed on an inner surface of the first side portion of the cover that is oriented so as to face the second side portion of the cover, and a second undercut region, which is delimited by mutually spaced hook-shaped lugs, is formed on an inner surface of the second side portion of the cover that is oriented so as to face the first side portion of the cover. The hook-shaped lugs of the relevant side portion are in each case mutually spaced in the vertical direction and in each case form, in particular with respect to the transverse direction, an undercut. The undercut region may for example form a guideway for securing a reflector device or the like.

According to some embodiments, a first L-shaped projection that projects towards the second side wall is formed on the first side wall and a second L-shaped projection that projects towards the first side wall is formed on the second side wall, the first and the second projection each overlapping with an edge region of the support plate. In particular, the projections are formed in a region of the relevant side wall that is located between the cover wall and the holder with respect to the vertical direction. The L-shaped projections each comprise a transverse leg that extends in the transverse direction and a vertical leg that extends therefrom towards the support plate of the lamp device and thus in the vertical direction. An end of the vertical leg may optionally be in contact with the support plate of the lamp device. It is generally possible for the distance between the end of the vertical leg and the support plate to be less than the thickness of the support plate, i.e. as short a distance as possible is between the first and the second surface of the support plate. As a result, the possibility of accessing the receiving space can be better prevented.

According to some embodiments, the support plate is produced from an aluminium material. This brings the advantage of a mechanically extremely robust delimitation of the receiving space, which advantageously makes accessing the receiving space even more difficult. Since aluminium or aluminium alloys have a high thermal conductivity, heat is moreover better conducted away from the lamp device on account of the planar extension of the support plate.

According to another embodiment of the luminaire, the electrical connection device is spaced apart from the support plate of the lamp device. The connection device and the lamp device are accordingly arranged so as to be spatially separated. Since said components each constitute heat sources, the dissipation of heat is improved by the spatial separation of said components.

Spatial separation between the lamp device and the electrical connection device may for example be achieved by the connection device being fastened to the cover wall of the housing.

According to some embodiments, the at least one luminous element is designed as an LED luminous element, for example a chip-on-board LED luminous element.

"One-piece", "one-part", "integral" components or components formed "in one piece" is herein generally understood to mean that said components are present as a single part forming a material unit and are in particular produced as such, one component not being detachable from the other component without breaking the material bond.

With regard to directions and axes, in particular directions and axes that relate to the course of physical structures, a course of an axis, direction or structure "along" another axis or structure or "in" another direction is herein understood to mean that these, in particular the tangents resulting at a relevant point in the structures, in each case extend at an angle of less than or equal to 45 degrees, preferably less than 30 degrees, to one another and particularly preferably in parallel with one another.

With regard to directions and axes, in particular directions and axes that relate to the course of physical structures, a course of an axis, direction or structure "transverse" to another axis, direction or structure is herein understood to mean that these, in particular the tangents resulting at a relevant point in the structures, in each case extend at an angle of greater than or equal to 45 degrees, preferably greater than or equal to 60 degrees, to one another and particularly preferably perpendicularly to one another.

BRIEF DESCRIPTION OF THE DRAWINGS

The invention is described in the following with reference to the figures of the drawings, in which.

DETAILED DESCRIPTION OF SOME EMBODIMENTS

Unless otherwise stated, identical or functionally identical components are denoted by the same reference signs in the figures.

Figure 1:
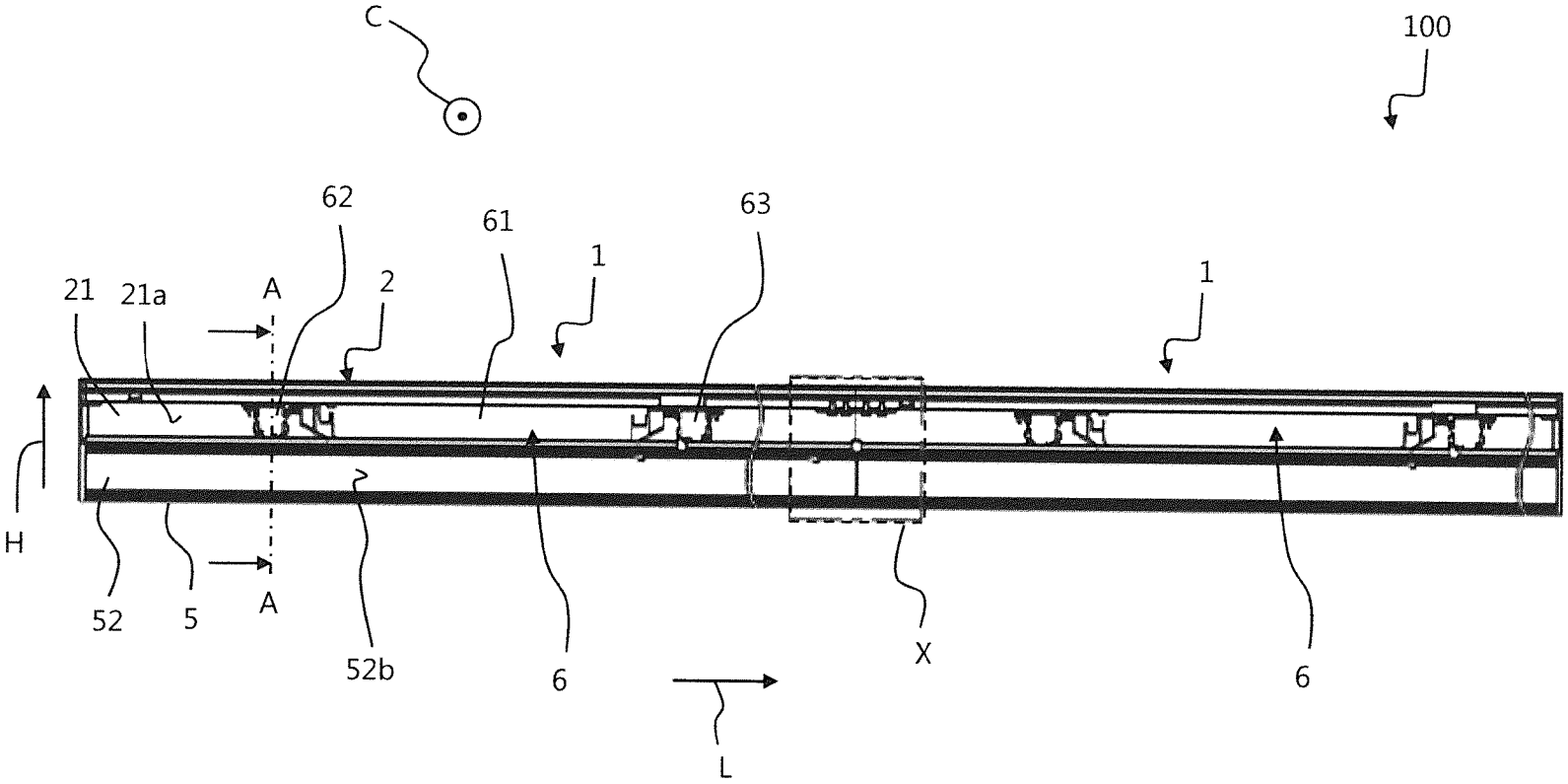
FIG. 1 is a sectional view of a luminaire system comprising luminaires according to an embodiment of the present invention, which view is produced by means of a section perpendicular to a transverse direction.

FIG. 1 shows an example of a luminaire system 100 comprising two luminaires 1 that are coupled to one another and are described in greater detail in the following. Each luminaire 1 comprises, as shown in FIGS. 1 and 2, a housing 2, a lamp device 3, a holder 4, a connection device 6 and an optional cover 5.

As shown in FIG. 1, the housing 2 extends in a longitudinal direction L. As shown in FIG. 2, the housing 2 comprises a first side wall 21, a second side wall 22 and a cover wall 23. The first and second side wall 21, 22 are arranged so as to be mutually spaced or opposite one another with respect to a transverse direction C extending transversely to the longitudinal direction L. In particular, an inner surface 21*a* of the first side wall 21 is oriented so as to face an inner surface 22*a* of the second side wall 22. As can be seen in FIGS. 1 and 2, the side walls 21, 22 may in particular be designed as elongate plates. The cover wall 23 extends between the first and second side wall 21, 22 in the transverse direction and connects the first and the second side wall 21, 22. In particular, the first and the second side wall 21, 22 and the cover wall 23 are produced in one piece, as shown by way of example in FIG. 2. As shown in FIG. 1, the cover wall 23 may also be produced as a plate extending in the longitudinal direction L.

Figure 2:
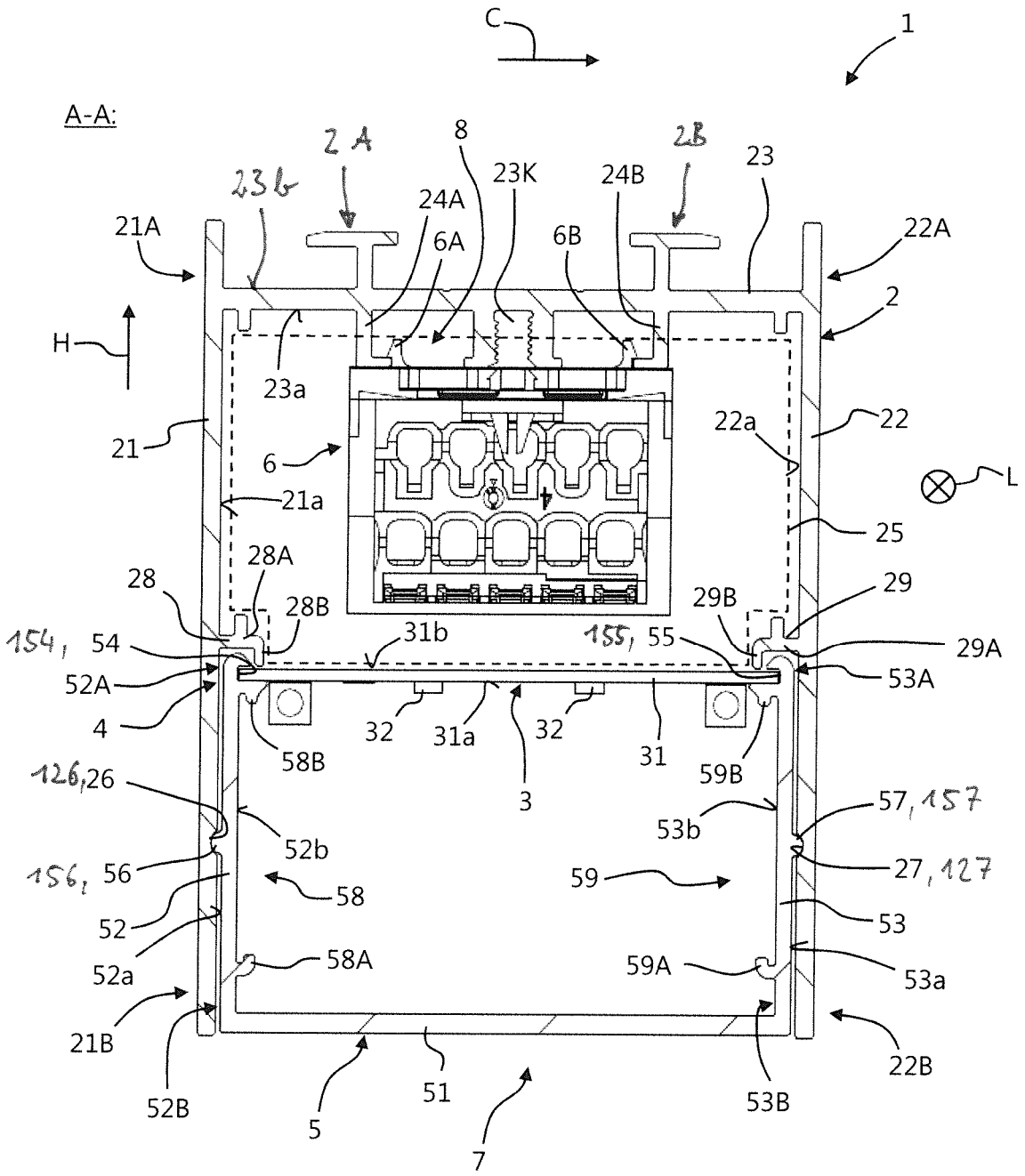
FIG. 2 is a sectional view of one luminaire of the luminaires of the luminaire system shown in FIG. 1, which view is produced by means of a section along the line A-A shown in FIG. 1.

As shown by way of example in FIG. 2, the cover wall 23 may in particular be connected to the first side wall 21 in the region of a first end portion 21A of the first side wall 21 and to the second side wall 22 in the region of a first end portion 22A of the second side wall 22. As can be seen in FIG. 2, an approximately U-shaped cross-section of the housing is produced in this way. A second end portion 21B of the first side wall 21, which is opposite the first end portion 21A with respect to a vertical direction H extending transversely to the transverse direction C, and a second end portion 22B of the second side wall 22, which is opposite the first end portion 22A of the second side wall 22 with respect to the vertical direction H, define a light outlet opening 7 of the luminaire with respect to the transverse direction C.

As can further be seen in FIG. 2, the housing 2 may further comprise one or more fastening lugs 2A, 2B which are provided for fastening the housing 2 to a ceiling (not shown) of a room or for fastening the housing 2 to a support device (not shown). The fastening lugs 2A, 2B may in particular be designed as profiled lugs, for example having a T-shaped cross-sectional shape, as shown by way of example in FIG. 2. As shown by way of example in FIG. 2, the fastening lugs 2A, 2B may be formed on an outer surface 23*b* of the cover wall 23 of the housing 2 or protrude from said outer surface, the outer surface 23*b* being oriented so as to face away from the light outlet opening 7.

As shown in particular in FIG. 2, the lamp device 3 comprises a support plate 31 and at least one luminous element 32. The luminous element 32 is arranged on a first surface 31*a* of the support plate and may in particular be designed as an LED luminous element. The support plate 31 is designed as a planarly extending component. Optionally, the support plate 31 may form a circuit board and may in particular be produced from an aluminium material.

The holder 4 couples the support plate 31 to the side walls 21, 22 of the housing 2. In FIG. 2, the holder 4 is designed, by way of example, as a holding structure formed on the optional cover 5.

The optional cover 5 comprises a main portion 51 that is transparent to visible light. Optionally, the cover 5 may further comprise a first side portion 52 and a second side portion 53, as shown by way of example in FIG. 2. The cover 5 is fastened to the side walls 21, 22.

As shown by way of example in FIG. 2, the main portion 51 may in particular be designed as a flat plate. However, the main portion may of course also be designed as a curved plate or as a dome or in a similar way. The main portion 51 of the cover 5 generally extends in the transverse direction C between the side walls 21, 22 and in this way covers the light outlet opening 7 in part or in full.

The first and the second side portion 52, 53 each extend transversely to the main portion 51 or project therefrom in the vertical direction H. As shown by way of example in FIG. 2, a cover 5 having an approximately U-shaped cross-sectional shape can be formed by means of the side portions 52, 53 and the main portion 51.

As shown in FIG. 2, the first side portion 52 of the cover extends along the first side wall 21 and the second side portion 53 extends along the second side wall 22.

The holder 4 shown by way of example is formed on the side portions 52, 53 of the cover 5. As shown by way of example in FIG. 2, the holder 4 is in each case formed in an end region 52A, 53A of the relevant side portion 52, 53 that is remote from the main portion 51 of the cover 5.

As shown in FIG. 2, the holder 4 may for example be formed by a first latching portion 54, which is provided on the first side portion 52 of the cover 5, and a second latching portion 55, which is provided on the second side portion 53 of the cover 5. In FIG. 2, the first latching portion 54 is, by way of example, produced as a receiving groove 154 that is formed in the end region 52A of the first side portion 52 of the cover 5. The second latching portion 55 is, by way of example, produced as a second receiving groove 155 that is formed in the end region 53A of the second side portion 53 of the cover 5. The receiving grooves 154, 155 each extend in the longitudinal direction L and may in particular extend over the entire length of the relevant side portion 52, 53. As shown in FIG. 2, the openings in the receiving grooves 154, 155 are oriented so as to face one another or the receiving grooves 154, 155 are each provided in mutually facing inner surfaces 52*b*, 53*b* of the side portions 52, 53. As further shown in FIG. 2, a first edge region of the support plate 31 of the lamp device 3 is received in the first receiving groove 154 and an edge region of the support plate 31 of the lamp device 3 that is opposite said first edge region with respect to the transverse direction C is received in the second receiving groove 155. The edge regions of the support plate 31 of the lamp device 3 are therefore generally held by means of the latching portions 54, 55. In this regard, the support plate 31 is oriented such that the first surface 31*a* of the support plate 31 and thus the at least one lighting unit 32 faces the light outlet opening 7 and a second surface 31*b* of the support plate 31 that is oriented in an opposite manner to the first surface 31*a* faces the cover wall 23 of the housing 2. As can be seen in FIG. 2, the first and the second side wall 21, 22, the cover wall 23 and the support plate 31 of the lamp device 3 define a receiving space 25 with respect to the transverse direction C and the vertical direction H. The receiving space 25 is schematically shown in FIG. 2 by means of a dashed line.

In general, the holder 4 couples the support plate 31 of the lamp device 3 to the sides walls 21, 22 such that the support plate 31, together with the side walls 21, 22 and the cover wall 23, define an enclosed receiving space 25.

The electrical connection device 6 is electrically connected to the lamp device 3 and is arranged in the receiving space 25. On account of the housing 2 and the lamp device 3, which is coupled to the side walls 21, 22 of the housing 2 via the holder 4, the possibility of unwanted access to the electrical connection device 6 is prevented in a reliable manner, said access being unwanted for example for safety reasons.

The side portions 52, 53 of the cover 5 may in particular be latched to the side walls 21, 22 of the housing 2 in an interlocking manner. The side portions 52, 53 of the cover 5 may for example be interlockingly secured to the side walls 21, 22 of the housing 2 in the manner shown in FIG. 2. In this regard, a first cover-latching structure, for example in the form of a latching lug 56, is formed on an outer surface 52*a* of the first side portion 52 of the cover 5 that is oriented so as to face the first side wall 21 of the housing 2 and thus is oriented in an opposite manner to the inner surface 52*b* of the first side portion 52. Said cover-latching structure engages in a first housing-latching structure, for example in the form of a latching recess 26, formed on the inner surface 21*a* of the first side wall 21. Furthermore, a second cover-latching structure, for example in the form of a latching lug 57, is formed on an outer surface 53*a* of the second side portion 53 of the cover 5 that is oriented so as to face the second side wall 22 of the housing 2 and is thus oriented in an opposite manner to the inner surface 53*b* of the second side portion 53, which second cover-latching structure engages in a second housing-latching structure, for example in the form of a latching recess 27, formed on the inner surface 22*a* of the second side wall 22.

As further shown in FIG. 2, a first undercut region 58 may be formed on the inner surface 52*b* of the first side portion 52 of the cover 5. Furthermore, a second undercut region 59 may be formed on the inner surface 53*b* of the second side portion 53 of the cover 5.

Two hook-shaped lugs 58A, 58B are provided on the inner surface 52*b* of the first side portion 52 in order to form the first undercut region 58 and are mutually spaced with respect to the vertical direction H. As shown by way of example in FIG. 2, a first lug 58A may be located in an end region 52B of the first side portion 52 located at the main portion 51. A second lug 58B is advantageously located in the region of the end region 58A of the first side portion 52 that is remote from the main portion 51.

Two hook-shaped lugs 59A, 59B are provided on the inner surface 53*b* of the second side portion 53 in order to form the second undercut region 59 and are mutually spaced with respect to the vertical direction H. As shown by way of example in FIG. 2, a first lug 59A may be located in an end region 53B of the second side portion 53 that is located at the main portion 51. A second lug 59B is advantageously located in the region of the end region 59A of the second side portion 53 that is remote from the main portion 51.

The undercut regions 58 and 59 delimited by the mutually spaced hook-shaped lugs 58A, 58B and 59A, 59B may for example be used to hold reflector sheets or the like, in order to improve the radiation efficiency of the luminaire 1.

As shown by way of example in FIG. 2, a first L-shaped projection 28 that projects towards the second side wall 22 may be formed on the first side wall 21 of the housing 2 and a second L-shaped projection 29 that projects towards the first side wall 21 may be formed on the second side wall 22. As shown in FIG. 2, the projections 28, 29 each project with a transverse portion 28A, 29A towards the opposing side wall 22, 21 and thereby each overlap with an edge portion of the support plate 31. A vertical portion 28B, 29B protrudes from the relevant transverse portion 28A, 29A towards the support plate 31 and preferably adjoins same. The projections 28, 29 may in particular be formed in one piece with the relevant side wall 21, 22. An enclosed receiving space 25 completely delimited by housing components 21, 22, 23, 28, 29 and the support plate 31 of the lamp device 3 is formed by the projections 28, 29, in particular holder 4 may advantageously be bridged.

As can be seen in FIG. 1, the electrical connection device 6 may for example comprise an electronic ballast 61 and connection terminals 62, 63. As shown in FIGS. 1 and 2, the electrical connection device 6 may in particular be fastened to the cover wall 23 of the housing 2, for example by means of a latching mechanism 8. The latching mechanism 8 may in particular comprise two L-shaped holding protrusions 24A, 24B, which protrude from an inner surface 23*a* of the cover wall 23 that faces the light outlet opening 7 and which are mutually spaced in the transverse direction C. Furthermore, the optional latching mechanism 8 is formed by resilient latching hooks 6A, 6A provided on the connection device 6 that engage the holding protrusions 24A, 24B from behind with respect to the vertical direction H and the transverse direction C. On account of the connection device 6 being fastened to the cover wall 23, the connection device 6 can be arranged in a simple manner so as to be spaced apart from the support plate 31 of the lamp device 3, which in particular improves the dissipation of heat from said components.

The luminaire system 100 shown by way of example in FIG. 1 comprises, as already mentioned, two luminaires 1 that are coupled to one another with respect to the longitudinal direction L. The luminaires 1 are mechanically coupled to one another. As shown by way of example in FIG. 3, this can be achieved by means of a housing coupling device 110. Said housing coupling device comprises a connector plate 111 and a plurality of securing devices 112, which may be realised by means of screws as shown by way of example in FIG. 3. Coupling profiles 23K are provided on the cover wall 23 of the housing 2 of the luminaires 1 in each case in the region of an end of the cover wall 23 with respect to the longitudinal direction L and are formed on the inner surface 23*a*. Recesses for receiving and holding the securing devices 112 are provided in each of the coupling profiles 23K. In the luminaire system 100 shown by way of example in FIG. 3, the securing devices 112 protrude in the form of screws through recesses 113 formed in the connector plate 111 and are screwed into the recesses in the coupling profiles 23K, in which an internal thread is formed.

Figure 3:
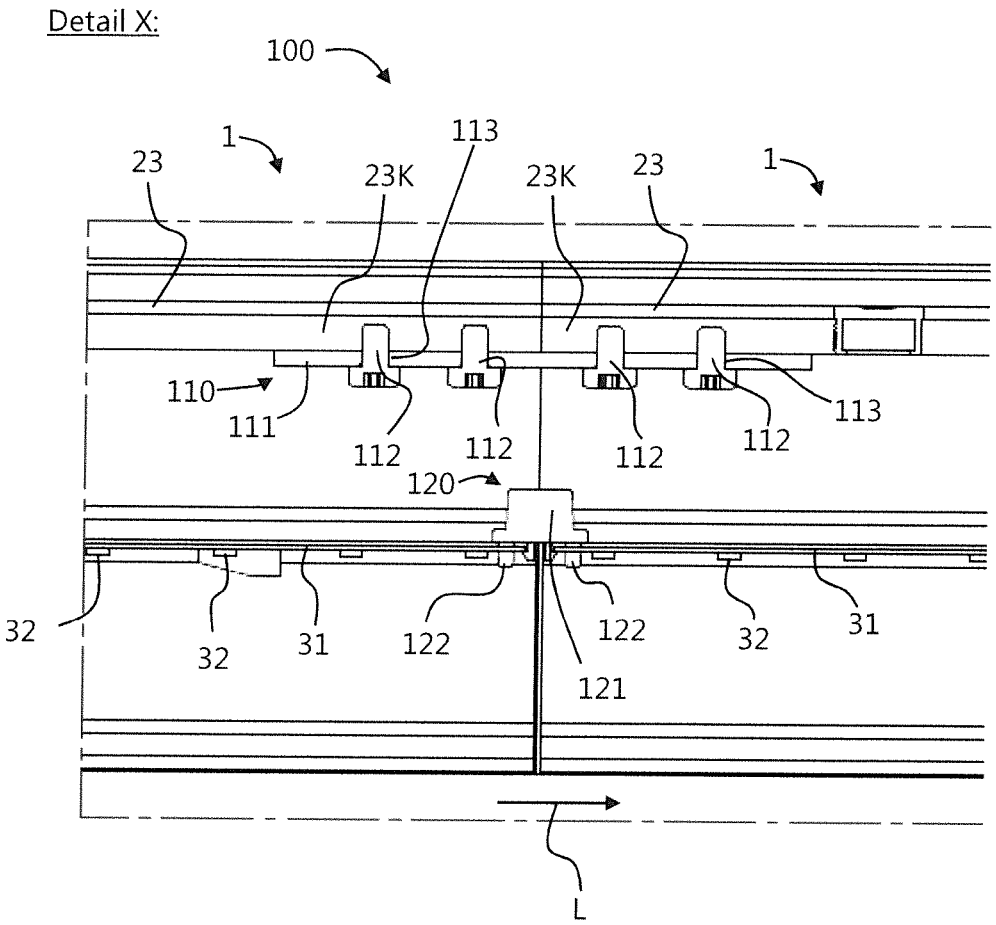
FIG. 3 is a detailed view of the region identified in FIG. 1 by the letter X.

As can further be seen in FIG. 3, the support plates 31 may optionally also be mechanically coupled to one another. For this purpose, a connector 120 may in particular be provided which comprises a hat-shaped base body 121 and two pins 122 protruding therefrom, each of which pins protrudes into a recess formed in the relevant support plate 31.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 10 2017 203 332, filed Mar. 1, 2017, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A luminaire comprising:

a housing extending in a longitudinal direction, the housing comprising a first side wall, a second side wall opposite the first side wall and a cover wall connecting the first and second side wall;

a lamp device comprising a support plate and at least one luminous element, the lamp device being arranged on a first surface of the support plate;

a transparent cover including a main portion that extends between the first side wall and the second side wall and that is fastened to the first side wall and the second side wall, a first side portion extending transversely to the main portion of the cover and along the first side wall, a second side portion extending transversely to the main portion of the cover and along the second side wall, a holder formed by a first latching portion formed in the first side portion and by a second latching portion formed in the second side portion, a first edge region of the support plate being held by the first latching portion and a second edge region being held by the second latching portion, whereby the support plate of the lamp device is coupled to the side walls such that the support plate, together with the first side wall, the second side wall and the cover wall, defines an enclosed receiving space;

an electrical connection device electrically connected to the lamp device and arranged in the enclosed receiving space.

2. The luminaire of claim 1, wherein the first latching portion is formed by a first receiving groove extending in the first side portion of the transparent cover and the second latching portion is formed by a second receiving groove extending in the second side portion of the transparent cover, the first edge region of the support plate being received in the first receiving groove and the second edge portion of the support plate being received in the second receiving groove.

3. The luminaire of claim 2, wherein the first latching portion and the second latching portion are each in the shape of a receiving groove.

4. The luminaire of claim 1, wherein the first and second side portions of the transparent cover are latched to the first and second side walls of the housing in an interlocking manner.

5. The luminaire of claim 4, wherein a first cover-latching structure is formed on an outer surface of the first side portion of the transparent cover that faces the first side wall of the housing, which first cover-latching structure engages in a first housing-latching structure formed on the first side wall, and a second cover-latching structure is formed on an outer surface of the second side portion of the transparent cover that faces the second side wall of the housing, which second cover-latching structure engages in a second housing-latching structure formed on the second side wall.

6. The luminaire of claim 5, wherein the first cover-latching structure is in the shape of a latching lug, the first housing-latching structure in in the shape of a latching recess, the second cover-latching structure is in the shape of a latching lug and the second housing-latching structure is in the shape of a latching recess.

7. The luminaire of claim 1, wherein a first undercut region, which is delimited by mutually spaced hook-shaped lugs, is formed on an inner surface of the first side portion of the transparent cover that is oriented so as to face the second side portion of the transparent cover, and a second undercut region, which is delimited by mutually spaced hook-shaped lugs, is formed on an inner surface of the second side portion of the transparent cover that is oriented so as to face the first side portion of the transparent cover.

8. The luminaire of claim 1, wherein a first L-shaped projection that projects towards the second side wall is formed on the first side wall and a second L-shaped projection that projects towards the first side wall is formed on the second side wall, the first and the second L-shaped projection each overlapping with an edge region of the support plate.

9. The luminaire of claim 1, wherein the support plate comprises an aluminum material.

10. The luminaire of claim 1, wherein the electrical connection device is arranged so as to be spaced apart from the support plate of the lamp device.

11. The luminaire of claim 10, wherein the electrical connection device is fastened to the cover wall of the housing.

12. The luminaire of claim 1, wherein the at least one luminous element comprises an LED luminous element.

13. The luminaire of claim 1, wherein the holder is formed in an end region of each of the first side portion and the second side portion, and wherein the end region that is remote from the main portion of the cover.

* * * * *